US008025122B2

(12) United States Patent
Gilcreest et al.

(10) Patent No.: US 8,025,122 B2
(45) Date of Patent: Sep. 27, 2011

(54) ACOUSTICALLY TREATED EXHAUST CENTERBODY FOR JET ENGINES AND ASSOCIATED METHODS

(75) Inventors: Mark D. Gilcreest, Kent, WA (US); Trevor G. Sleath, Bellevue, WA (US); Daniel F. Gelzer, Bellevue, WA (US); Merlin C. Windels, Renton, WA (US)

(73) Assignee: The Boeing Company, Chicago, IL (US)

( * ) Notice: Subject to any disclaimer, the term of this patent is extended or adjusted under 35 U.S.C. 154(b) by 85 days.

(21) Appl. No.: 12/266,431

(22) Filed: Nov. 6, 2008

(65) Prior Publication Data

US 2010/0108436 A1 May 6, 2010

(51) Int. Cl.

| | |
|---|---|
| ***F02K 1/82*** | (2006.01) |
| ***F02K 1/04*** | (2006.01) |
| ***F02K 1/40*** | (2006.01) |
| *F01K 1/00* | (2006.01) |
| *B64D 33/02* | (2006.01) |

(52) U.S. Cl. ..... 181/213; 181/214; 60/770; 415/115; 415/119

(58) Field of Classification Search ..... 181/210, 181/213, 215, 258, 250, 214; 244/1 N, 53 B; 60/770, 262, 263; 239/265.11, 265.13, 265.19, 239/265.27; 415/115, 119

See application file for complete search history.

(56) References Cited

U.S. PATENT DOCUMENTS

| | | | | | |
|---|---|---|---|---|---|
| 2,990,906 | A | * | 7/1961 | Audette | 181/256 |
| 3,212,603 | A | * | 10/1965 | Walker | 181/250 |
| 3,948,346 | A | * | 4/1976 | Schindler | 181/286 |
| 4,064,961 | A | * | 12/1977 | Tseo | 181/213 |
| 4,100,993 | A | * | 7/1978 | Feder | 181/213 |
| 4,137,992 | A | * | 2/1979 | Herman | 181/213 |
| 4,226,297 | A | * | 10/1980 | Cicon | 181/213 |
| 4,236,598 | A | * | 12/1980 | Wirt | 181/231 |
| 4,240,519 | A | * | 12/1980 | Wynosky | 181/213 |
| 4,258,822 | A | * | 3/1981 | Streib | 181/213 |
| 4,433,751 | A | * | 2/1984 | Bonneau | 181/213 |
| 5,041,323 | A | * | 8/1991 | Rose et al. | 428/116 |
| 5,162,620 | A | * | 11/1992 | Ross et al. | 181/220 |
| 5,388,765 | A | * | 2/1995 | Hill et al. | 239/127.3 |
| 5,997,985 | A | * | 12/1999 | Clarke et al. | 428/116 |
| 6,530,221 | B1 | * | 3/2003 | Sattinger et al. | 181/213 |
| 6,615,576 | B2 | * | 9/2003 | Sheoran et al. | 60/39.5 |
| 6,845,607 | B2 | * | 1/2005 | Lair | 60/263 |

(Continued)

OTHER PUBLICATIONS

Yu et al.; "Folding Cavity Acoustic Liner for Combustion Noise Reduction"; 12th AIAA/CEAS Aeroacoustics Conference (27th AIAA Aeroacoustics Conference); May 8-10, 2006; Cambridge, Massachusetts; Goodrich Corporation; American Institute of Aeronautics and Astronautics, Inc.; AIAA 2006-2681.

*Primary Examiner* — Edgardo San Martin

(74) *Attorney, Agent, or Firm* — Yee & Associates, P.C.

(57) ABSTRACT

An acoustically treated exhaust centerbody comprising a body including a body fore portion and a body aft portion. An internal passageway extends through the body in the axial direction. A resonator in the body fore portion includes a plurality of acoustic chambers. A plurality of ribs in the resonator form fore/aft walls of the acoustic chambers. Each rib is shaped substantially as a section of an annulus. A plurality of radial fins extend between adjacent ribs. The fins form sidewalls of the acoustic chambers. A skin overlies the acoustic chambers and forms an outer surface of the resonator.

24 Claims, 13 Drawing Sheets

U.S. PATENT DOCUMENTS 6,935,834 B2 * 8/2005 Lata Perez ..... 415/115
7,387,188 B2 * 6/2008 Keller et al. ..... 181/250
2007/0256889 A1 * 11/2007 Yu et al. ..... 181/214
2010/0276548 A1 * 11/2010 Porte et al. ..... 244/53 B

* cited by examiner

ACOUSTICALLY TREATED EXHAUST CENTERBODY FOR JET ENGINES AND ASSOCIATED METHODS

BACKGROUND

1. Technical Field

The present disclosure relates to acoustic treatments for jet engines.

2. Description of Related Art

Acoustic treatments for jet engine exhaust are generally exposed to significant thermal gradients in the radial direction. These gradients are apparent for exhaust nozzles that are exposed to primary flow on one side, and fan flow on the other. They are also apparent for exhaust centerbodies that are internally vented, which are exposed to primary flow on one side and scavenged air on the other. These gradients are further apparent for any exhaust components at engine startup where the surfaces bounding the primary flow are at temperatures well in excess of the surrounding structure. This temperature differential can be in excess of 1000 degrees Fahrenheit. A thermal gradient of this magnitude can induce significant structural load. And due to the direction of the thermal gradient (away from the primary flow), this issue is critically important to the design of acoustic treatments on exhaust centerbodies.

One type of acoustic treatment includes an acoustic chamber that traps sound energy. The acoustic chamber lies beneath an outer perforated skin of the acoustic treatment. Existing designs limit the depth of the acoustic chamber to about one half inch, because as the depth of the acoustic chamber increases so does the thermal gradient across the chamber. Unfortunately, limiting the depth of the acoustic chamber also limits the range of frequencies that the chamber may attenuate. Accordingly, there is a need to increase the ability of acoustic chambers to withstand the stresses generated by thermal gradients so that the depths of the chambers may also be increased.

SUMMARY

The embodiments of the present acoustically treated exhaust centerbody for jet engines and associated methods have several features, no single one of which is solely responsible for their desirable attributes. Without limiting the scope of the present embodiments as expressed by the claims that follow, their more prominent features now will be discussed briefly. After considering this discussion, and particularly after reading the section entitled "Detailed Description," one will understand how the features of the present embodiments provide advantages, which include increased ability to withstand thermal stresses.

One aspect of the present acoustically treated exhaust centerbody includes the realization that it would be desirable to increase the depth of the acoustic chamber(s), to broaden the range of attenuated frequencies. In order to increase the depth of the chamber(s), however, the ability of the chamber(s) to withstand thermal stresses must also increase. The present embodiments enable the depth of the chamber(s) to be increased by providing axial (fore/aft) corrugations that enable the resonator to expand and contract axially. Similarly, cavities between adjacent chambers provide circumferential (hoopwise) corrugations that enable the resonator to expand and contract circumferentially and radially. The entire resonator thus acts much like the pleats in an accordion as it expands and contracts under thermal stresses.

One embodiment of the present acoustically treated exhaust centerbody comprises a body including a body tore portion and a body aft portion. An internal passageway extends through the body in the axial direction. A resonator in the body fore portion includes a plurality of acoustic chambers. A plurality of ribs in the resonator form fore/aft walls of the acoustic chambers. Each rib is shaped substantially as a section of an annulus. A plurality of radial fins extend between adjacent ribs. The fins form sidewalls of the acoustic chambers. A skin overlies the acoustic chambers and forms an outer surface of the resonator.

One embodiment of the present methods of attenuating sound energy generated by a jet engine comprises installing an exhaust centerbody within an exhaust system of the jet engine. The method further comprises passing exhaust gases from the jet engine over the exhaust centerbody, and trapping sound energy generated by the jet engine in a resonator within the exhaust centerbody. The resonator includes a plurality of acoustic chambers. A plurality of ribs in the resonator form fore/aft walls of the acoustic chambers. A plurality of radial fins extend between adjacent ribs. The fins form sidewalls of the acoustic chambers. A perforated skin overlies the acoustic chambers and forms an outer surface of the resonator.

Another embodiment of the present acoustically treated exhaust centerbody is configured to be disposed within an exhaust nozzle of a jet engine so that exhaust gases from the jet engine travel over an outside surface of the exhaust centerbody, while vented air from the jet engine travels through an internal passageway of the exhaust centerbody. The exhaust centerbody is further configured to attenuate sound energy generated by the jet engine. The exhaust centerbody comprises a body including a body fore portion and a body aft portion with the internal passageway extending through the body in an axial direction and being configured to receive the vented air from the jet engine. The exhaust centerbody further comprises a resonator in the body fore portion. The resonator includes a plurality of acoustic chambers configured to trap the sound energy. The exhaust centerbody further comprises a plurality of ribs in the resonator, each rib forming a fore/aft wall of one of the acoustic chambers and being shaped substantially as a third of an annulus. The exhaust centerbody further comprises a plurality of radial fins extending between adjacent ribs, the fins forming sidewalls of the acoustic chambers. The exhaust centerbody further comprises three cavities extending in radial and axial directions through the resonator and subdividing the acoustic chambers into three circumferentially spaced groups, the radial fins defining sidewalls of the cavities. The exhaust centerbody further comprises a skin overlying the acoustic chambers and forming an outer surface of the resonator, the skin including perforations that enhance the ability of the acoustic chambers to trap the sound energy.

Another embodiment of the present methods of attenuating sound energy generated by a jet engine comprises attenuating the sound energy using an exhaust centerbody disposed within an exhaust nozzle of the jet engine. The method further comprises installing the exhaust centerbody within the exhaust nozzle of the jet engine. The method further comprises passing exhaust gases from the jet engine over the exhaust centerbody. The method further comprises passing vented air from the jet engine through an internal passageway of the exhaust centerbody. The method further comprises trapping the sound energy generated by the jet engine in a resonator within the exhaust centerbody. The resonator includes a body including a body fore portion and a body aft portion, with the internal passageway extending through the body in an axial direction and being configured to receive the vented air from the jet engine. The resonator further includes a resonator in the body fore portion, the resonator including a plurality of acoustic chambers configured to trap the sound energy. The resonator further includes a plurality of ribs in the resonator, each rib forming a fore/aft wall of one of the acoustic chambers and being shaped substantially as a third of an annulus. The resonator further includes a plurality of radial fins extending between adjacent ribs, the fins forming sidewalls of the acoustic chambers. The resonator further includes three cavities extending in radial and axial directions through the resonator and subdividing the acoustic chambers into three circumferentially spaced groups, the radial fins defining sidewalls of the cavities. The resonator further includes a skin overlying the acoustic chambers and forming an outer surface of the resonator, the skin including perforations that enhance the ability of the acoustic chambers to trap the sound energy.

The features, functions, and advantages of the present embodiments can be achieved independently in various embodiments, or may be combined in yet other embodiments.

BRIEF DESCRIPTION OF THE DRAWINGS

The embodiments of the present acoustically treated exhaust centerbody for jet engines and associated methods now will be discussed in detail with an emphasis on highlighting the advantageous features. These embodiments depict the novel and non-obvious exhaust centerbody for jet engines and associated methods shown in the accompanying drawings, which are for illustrative purposes only. These drawings include the following figures, in which like numerals indicate like parts.

DETAILED DESCRIPTION

Figure 1:
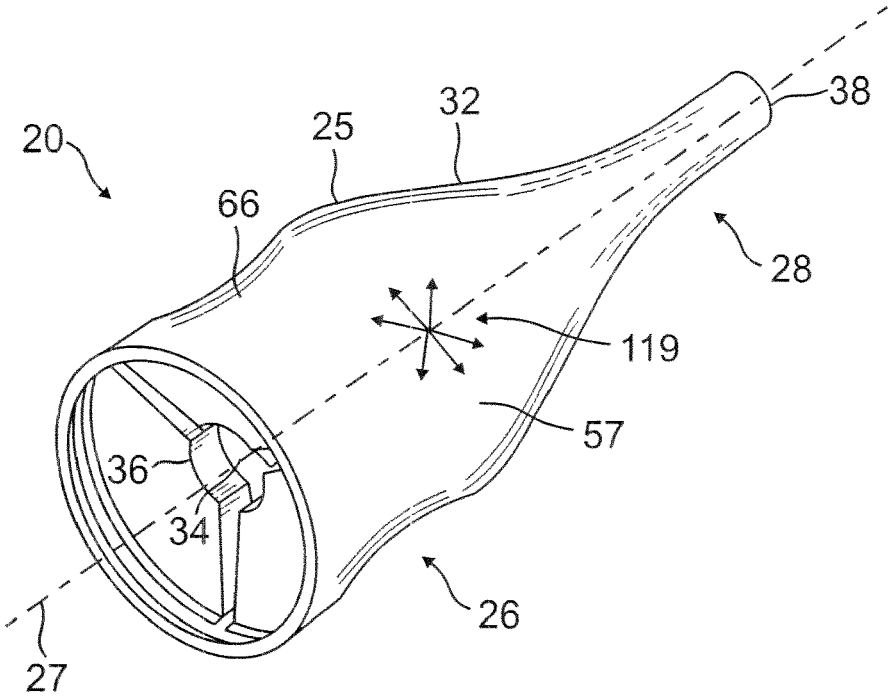
FIG. 1 is a front perspective view of one embodiment of the present acoustically treated exhaust centerbody.

In the detailed description that follows, the present embodiments are described with reference to the drawings. In the drawings, elements of the present embodiments are labeled with reference numbers. These reference numbers are reproduced below in connection with the discussion of the corresponding drawing features.

FIGS. 1-4 illustrate one embodiment of the present acoustically treated exhaust centerbody 20. With reference to FIG. 5, the exhaust centerbody 20 is configured to fit within a jet engine exhaust nozzle 22, both of which are attached to the jet engine 24. In this configurations, exhaust gases 21 from the jet engine 24 travel over the outside surface of the exhaust centerbody 20, while vented air 23 from the jet engine 24 travels through an internal passageway of the exhaust centerbody 20, as shown in FIG. 5 and as described in detail below.

Figure 2:
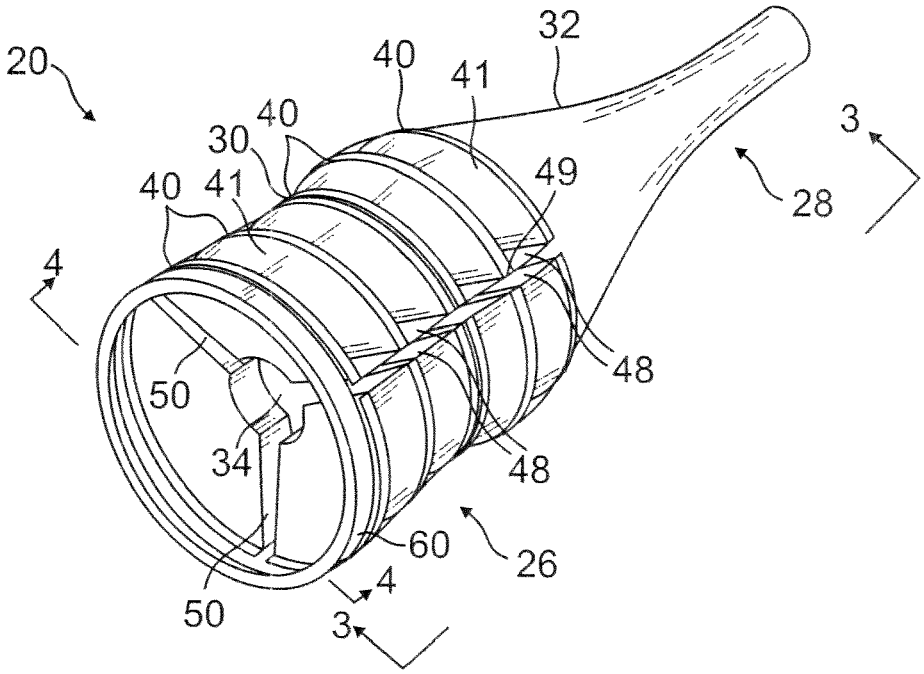
FIG. 2 is a front perspective view of the exhaust centerbody of FIG. 1 showing the skill over the resonator removed.
Figure 3:
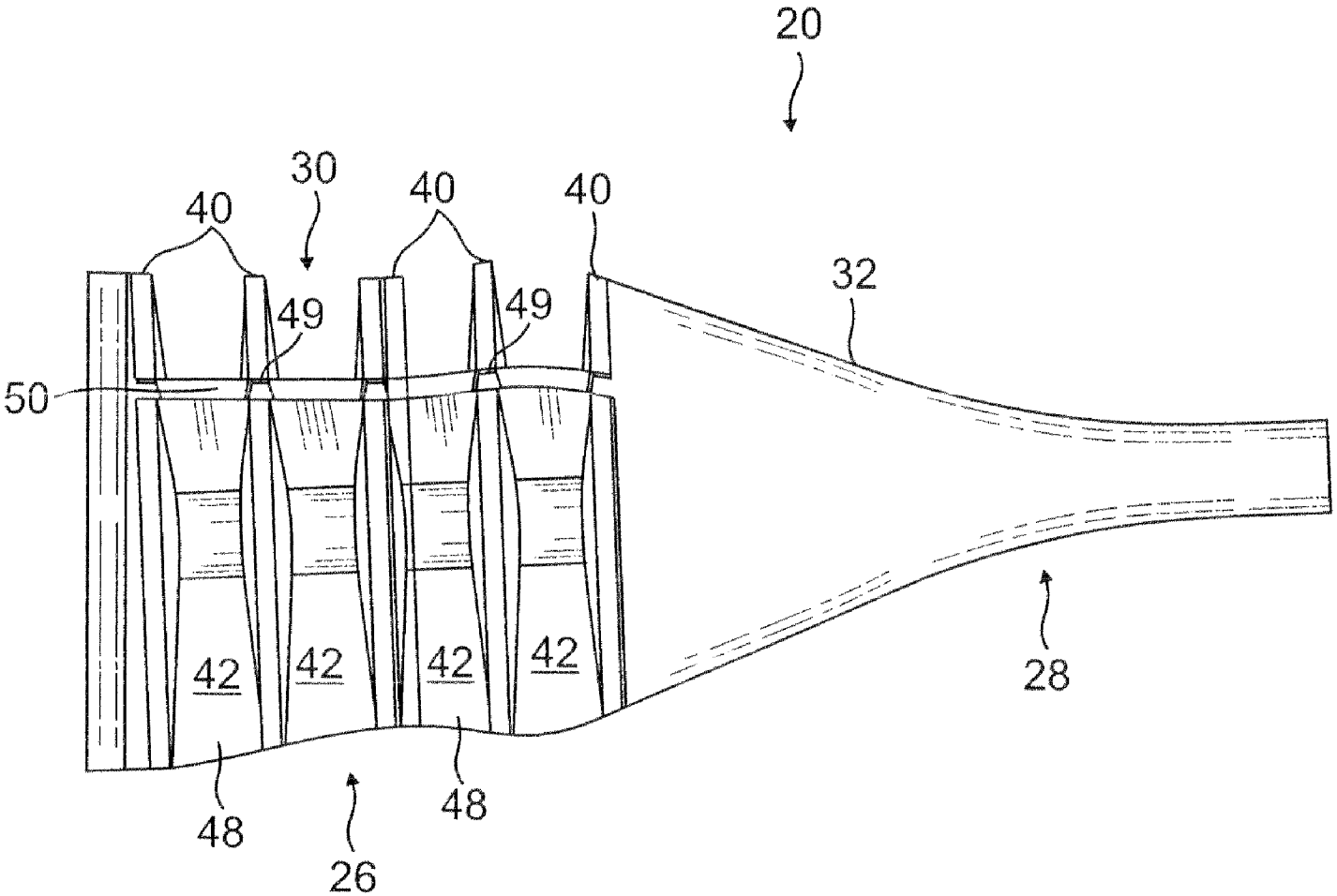
FIG. 3 is a right-side elevation view of the exhaust centerbody of FIG. 2.

With reference to FIGS. 1-3, the exhaust centerbody 20 comprises a body 25 including a fore portion 26 and an aft portion 28. The body fore portion 26 comprises a resonator 30 (FIGS. 2 and 3), which is described in further detail below. The body aft portion 28 comprises a smoothly tapering outer surface 32 that is shaped substantially as a funnel. The outer surface 32 tapers inward in a fore-to-aft direction. An internal passageway 34 extends through the body 25 in an axial direction 27 from an inlet 36 in the body fore portion 26 to an outlet 38 in the body aft portion 28 (FIG. 1). The internal passageway 34 carries vented air from the jet engine 24, as described in further detail below.

With reference to FIGS. 2 and 3, the resonator 30 includes a plurality of ribs 40 that subdivides the resonator 30 into a plurality of acoustic chambers 42 (FIG. 3). The acoustic chambers 42 trap sound energy and attenuate the ambient noise generated by the jet engine 24. The ribs 40 form fore and aft walls of the acoustic chambers 42. Each rib 40 is shaped substantially as a section of an annulus. In the embodiment illustrated in FIG. 1-4, each rib 40 is shaped substantially as a third of an annulus. However, in alternative embodiments the ribs 40 may be shaped differently. For example, in the resonator 44 of FIGS. 10-13 each rib 46 is shaped substantially as a half annulus. The ribs 40, 46 advantageously disrupt axial stresses in the resonator 30, 44, thereby increasing the capacity of the exhaust centerbody 20 to withstand thermal stresses, as discussed in further detail below.

With reference to FIGS. 2 and 3, a plurality of radial fins 48 extends between adjacent ribs 40 at side edges 49 of the ribs 40. The fins 48 form sidewalls of the acoustic chambers 42. In certain embodiments a unitary sheet extending axially may form multiple fins 48, such as all of the fins 48 extending fore to aft on one side of a group of acoustic chambers 42. In alternative embodiments each fin 48 may be formed as a separate piece extending only between adjacent ribs 40.

Figure 4:
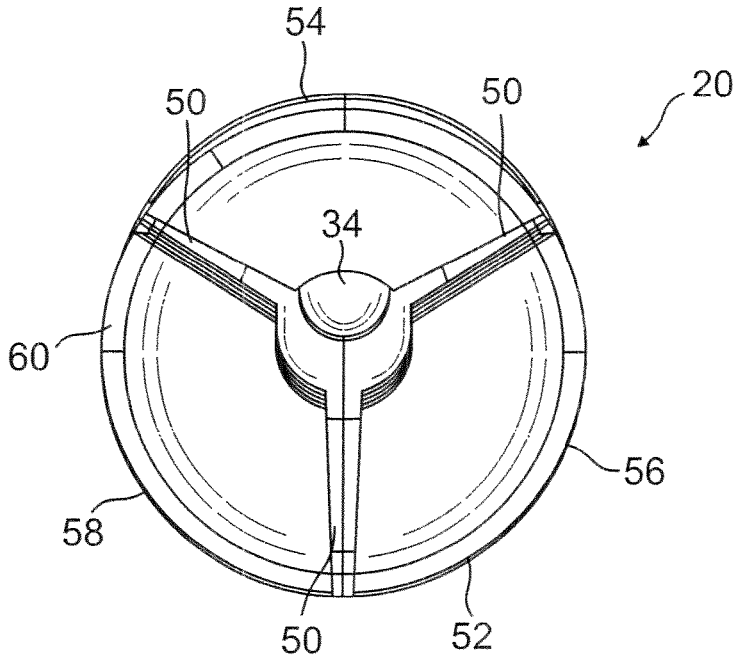
FIG. 4 is a front elevation view of the exhaust centerbody of FIG. 2.
Figure 5:
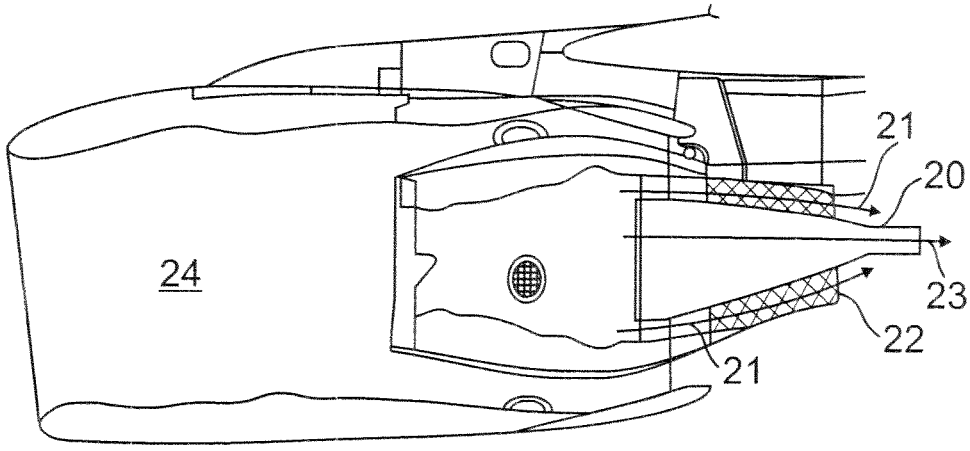
FIG. 5 is a right-side section view cut through a jet engine with the exhaust centerbody of FIG. 1 disposed within the exhaust system of the jet engine.

With reference to FIGS. 2-4, cavities 50 extend through the resonator 30 in the radial and axial directions. The radial fins 48 define sidewalls of the cavities 50, such that the cavities 50 separate adjacent acoustic chambers 42 in the circumferential direction. With reference to FIG. 3, each cavity 50 extends in the radial direction from the internal passageway 34 to the outer surface 52 of the resonator 30. The cavities 50 thus subdivide the acoustic chambers 42 into circumferentially spaced groups 54, 56, 58. Each group 54, 56, 58 of acoustic chambers 42 is anchored at the fore end by a ring 60 (FIGS. 2 and 4), and at the aft end by the aft portion 28. The groups 54, 56, 58, however, are not directly secured to one another.

In the embodiment of FIGS. 1-4 three cavities 50 are provided, subdividing the acoustic chambers 42 into three circumferentially spaced groups 54, 56, 58 (FIG. 4). In other embodiments, however, fewer or more cavities 50 may be provided, subdividing the acoustic chambers 42 into fewer or more circumferentially spaced groups. For example, in the embodiment of FIGS. 10-13 two cavities 50 are provided, subdividing the acoustic chambers 42 into two circumferentially spaced groups 62, 64. The cavities 50 advantageously disrupt hoop stresses in the resonator 30, 44, thereby increasing the capacity of the exhaust centerbody 20 to withstand thermal stresses, as discussed in further detail below.

Figure 7:
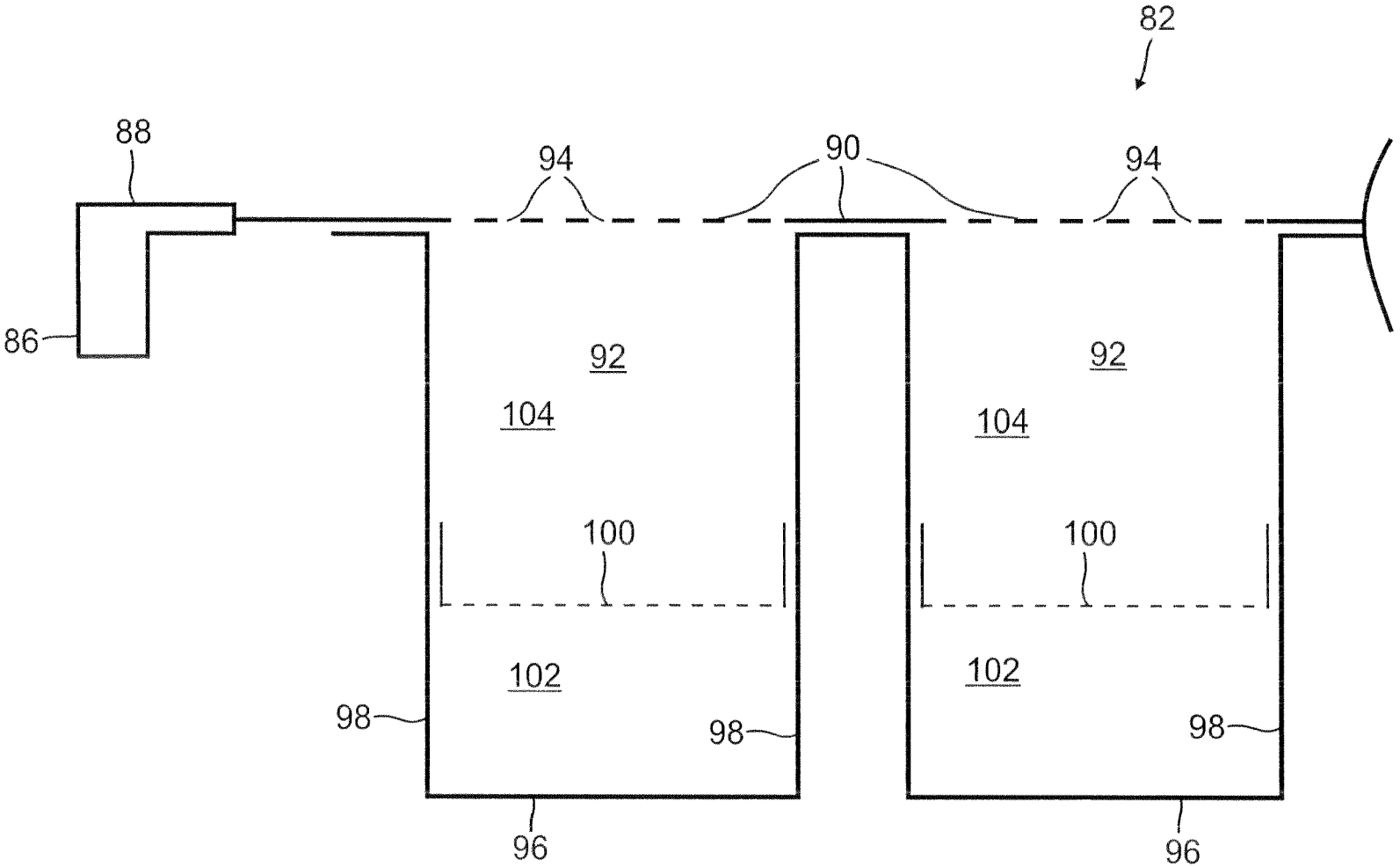
FIG. 7 is a schematic right-side elevation view of one embodiment of a resonator portion of another embodiment of the present acoustically treated exhaust centerbody.
Figure 8:
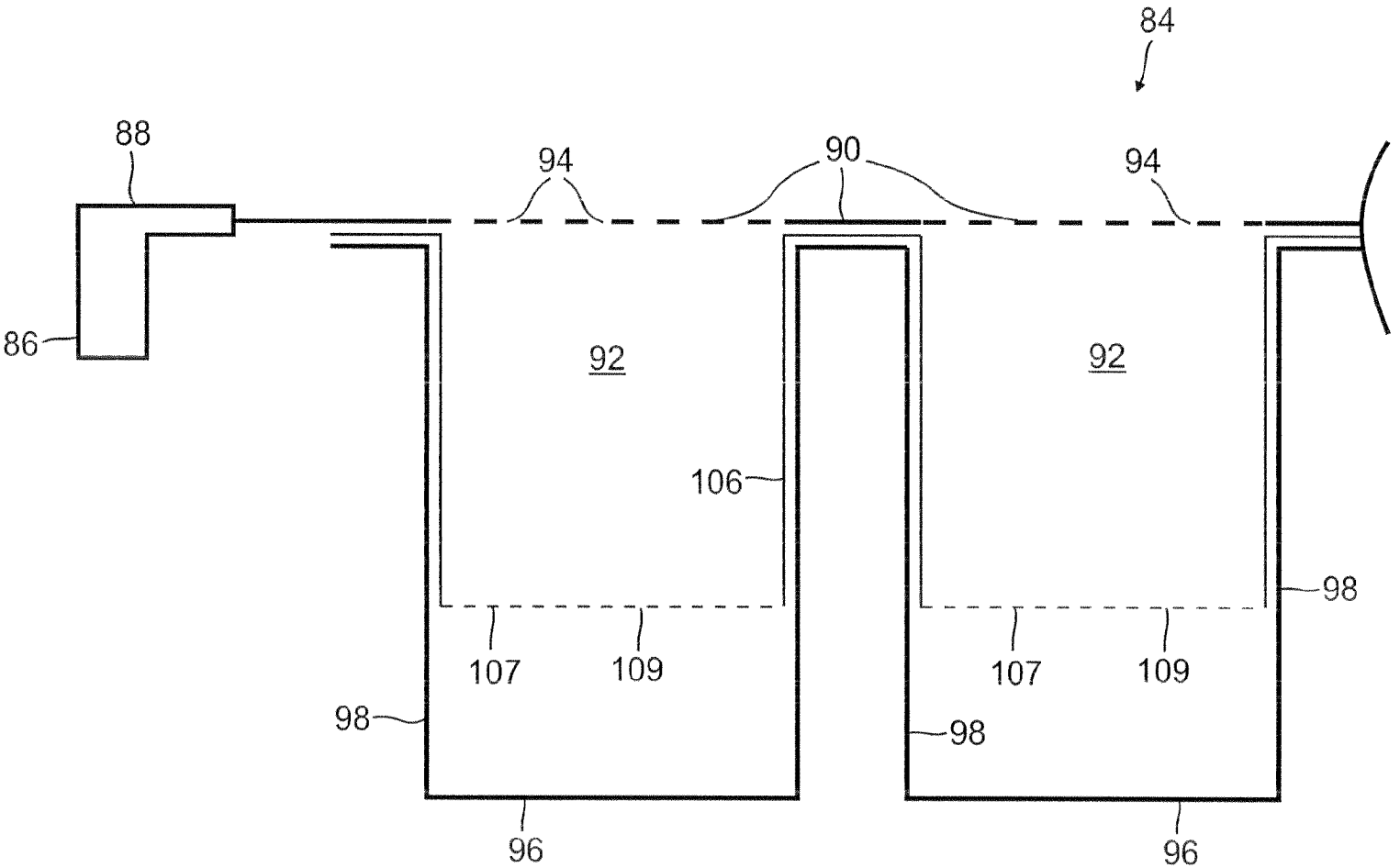
FIG. 8 is a schematic right-side elevation view of another embodiment of a resonator portion of another embodiment of the present acoustically treated exhaust centerbody.
Figure 9:
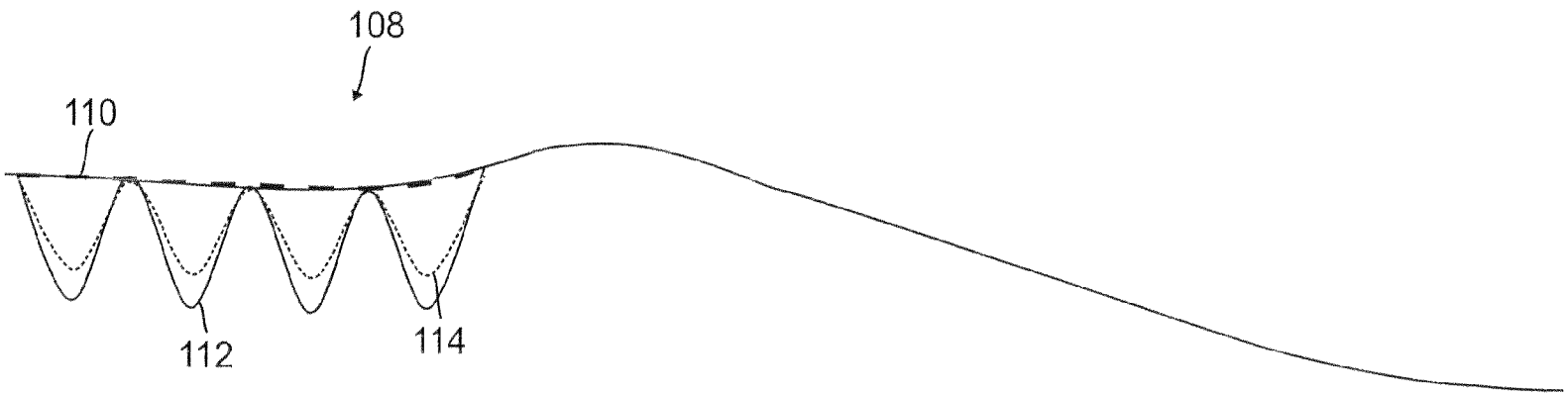
FIG. 9 is a schematic right-side elevation view of another embodiment of a resonator portion of another embodiment of the present acoustically treated exhaust centerbody.
Figure 10:
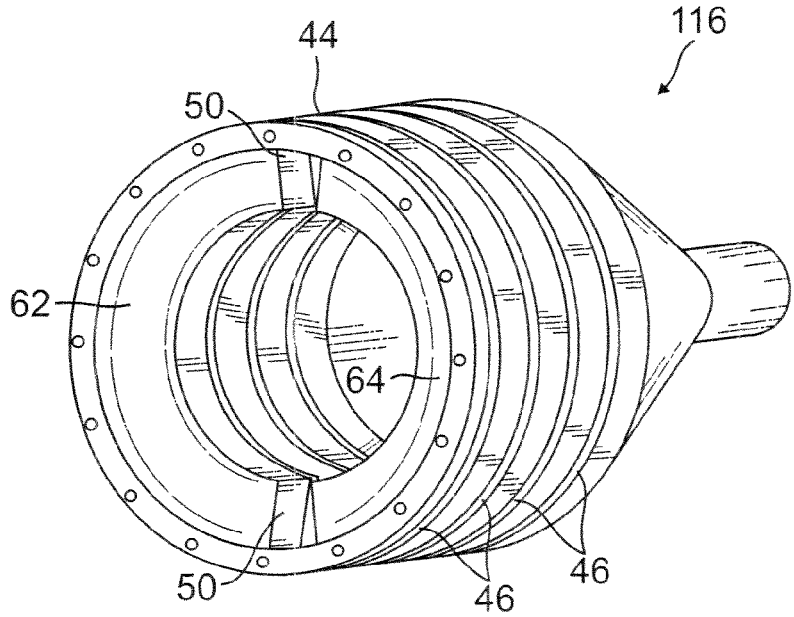
FIG. 10 is a front perspective view of another embodiment of the present acoustically treated exhaust centerbody.
Figure 11:
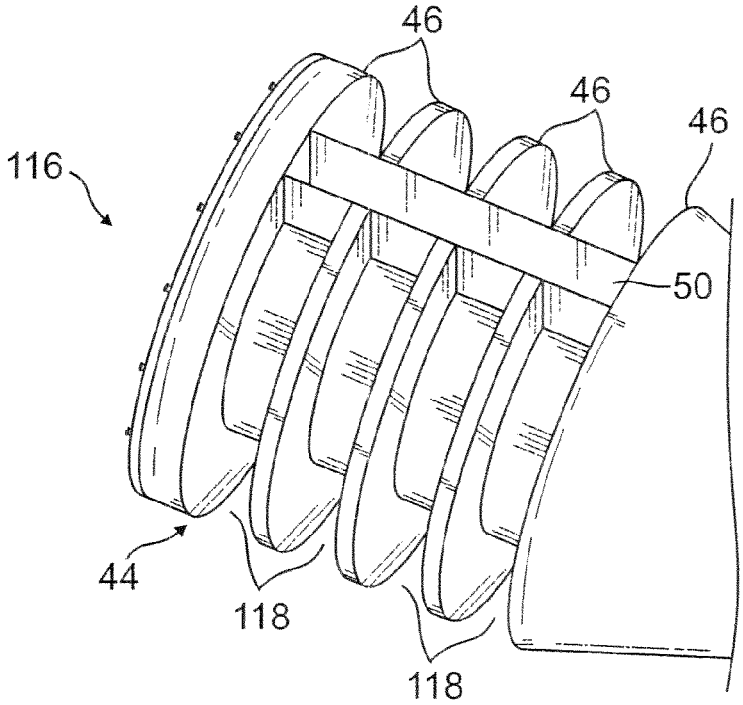
FIG. 11 is a top perspective view of the exhaust centerbody of FIG. 10.
Figure 12:
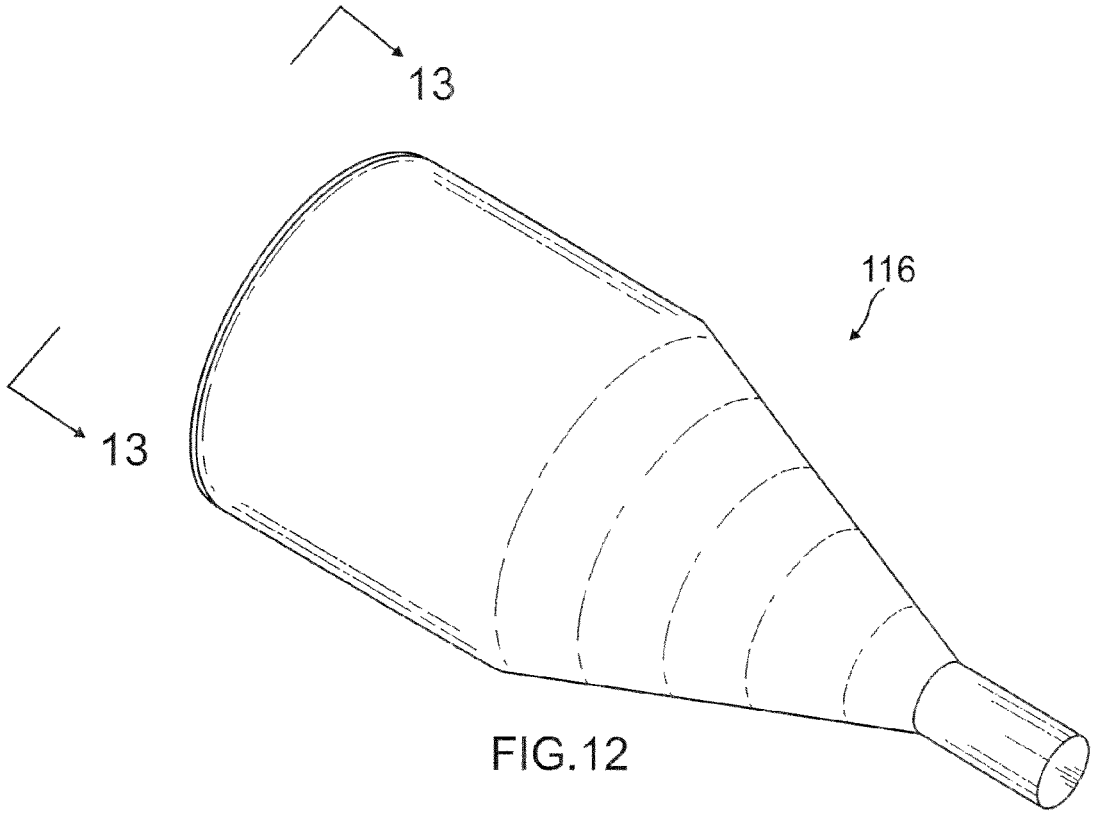
FIG. 12 is a top perspective view of the exhaust centerbody of FIG. 10 showing the skin over the resonator.
Figure 13:
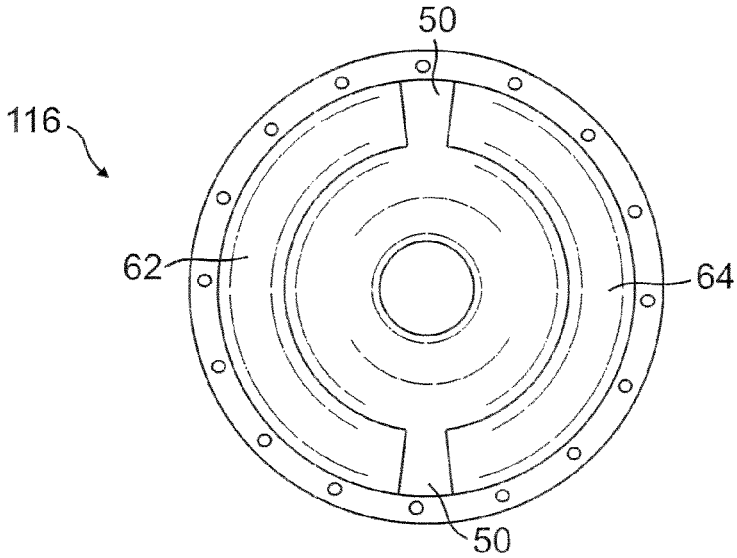
FIG. 13 is a front elevation view of the exhaust centerbody of FIG. 10.

With reference to FIG. 1, a skin 66 overlies the acoustic chambers 42 and forms the outer surface 57 of the resonator 30. The skin 66 is a relatively thin sheet material, and includes perforations overlying the acoustic chambers 42. The perforations, which are illustrated in FIGS. 7-9, facilitate the transmission of sound energy through the skin 66 and into the acoustic chambers 42. The acoustic chambers 42 trap and absorb the sound energy, thereby attenuating the targeted ambient noise generated by the jet engine. As the density of the perforations in the skin 66 increases from zero, the sound attenuation of the acoustic chambers 42 increases due to the increased ability of the sound energy to enter the acoustic chambers 42 through the perforations. However, the increase in performance has a limit where the increasing density of perforations compromises the ability of the perforated skin 66 to retain the sound energy that enters the acoustic chambers 42.

Figure 6A:
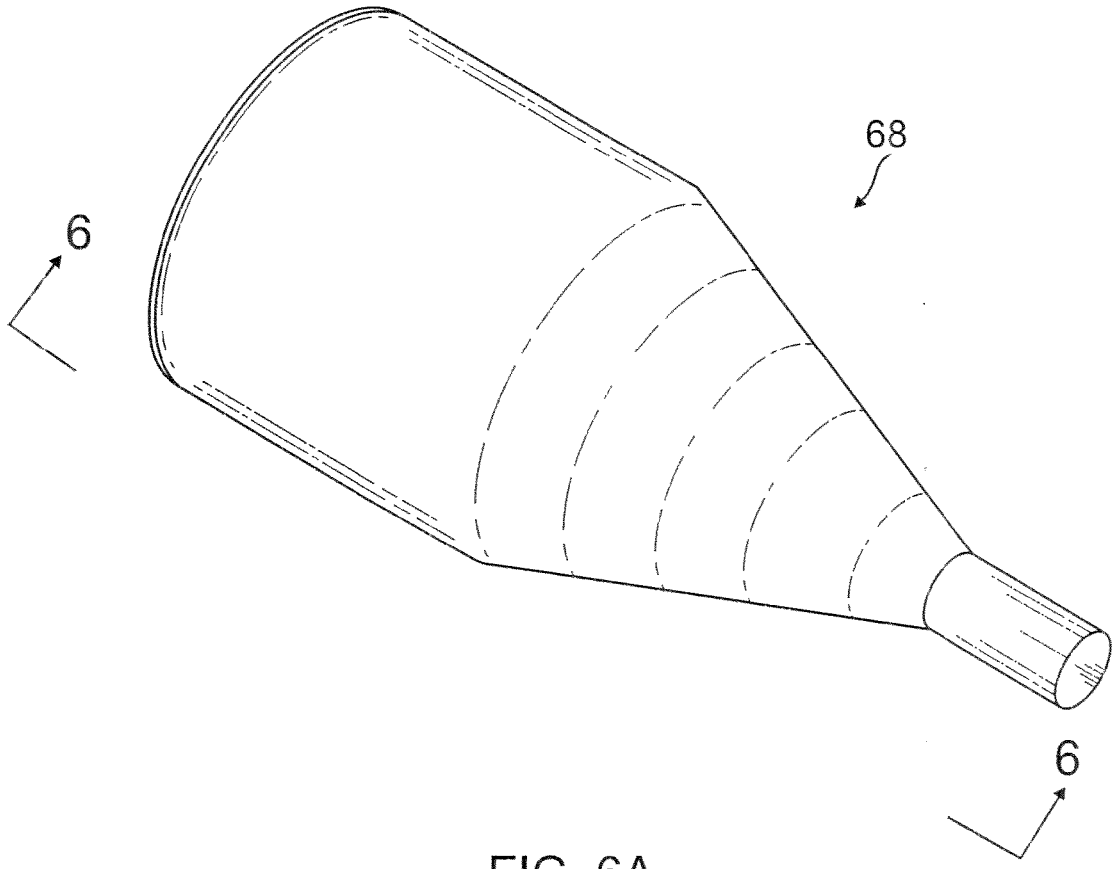
FIG. 6 is a rear perspective view of an axial slice of another embodiment of the present acoustically treated exhaust centerbody.
Figure 6:
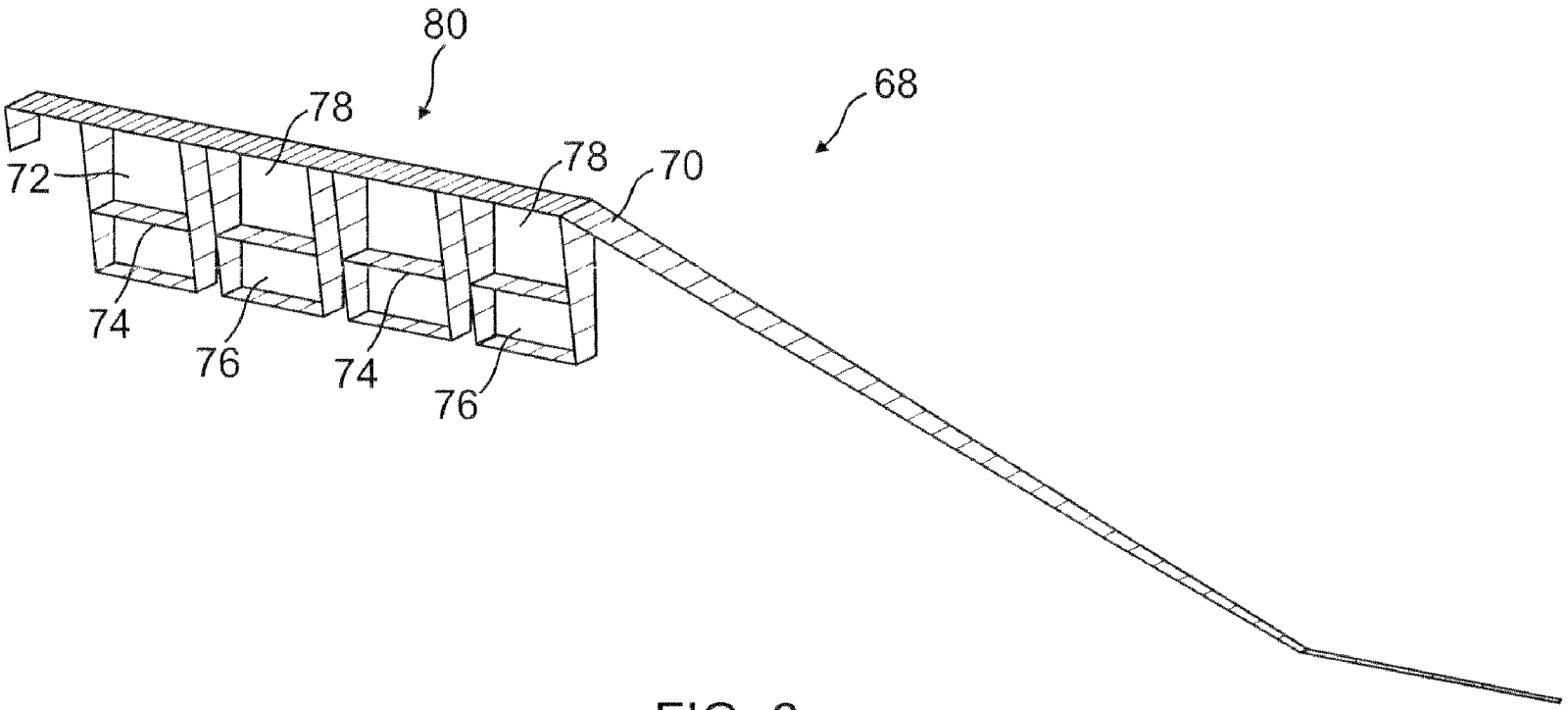

FIG. 6 illustrates an axial slice 68 of another embodiment of the present acoustically treated exhaust centerbody. The slice 68 illustrates the outer skin 70 of the exhaust centerbody from fore to aft, and the acoustic chambers 72. In the embodiment of FIG. 6 a perforated sheet 74 extends through each acoustic chamber 72. The perforated sheet 74 is located beneath the skin 70 and subdivides each acoustic chamber 72 into a radially inboard subchamber 76 and a radially outboard subchamber 78. The perforated sheet 74 advantageously enhances the sound attenuation properties of the resonator 80. However, the perforated sheet 74 may be omitted from certain embodiments where it is desired to reduce the overall weight of the exhaust centerbody. In other embodiments some of the acoustic chambers may be subdivided into radially inboard subchambers and radially outboard subchambers while other acoustic chambers may not be subdivided.

FIGS. 7 and 8 illustrate schematic side cross-sectional views of alternative embodiments of the resonator 82, 84 of the present acoustically treated exhaust centerbody. With reference to FIGS. 7 and 8, each illustrated embodiment of the resonator 82, 84 includes a fore ring 86 and a relatively thick sheet 88 extending in the aft direction from the ring 86. A relatively more thin skin 90 extends over acoustic chambers 92, and includes perforations 94 in the areas overlying the acoustic chambers 92. A sheet 96 underlies the skin 90 and forms the ribs 98 and the acoustic chambers 92. In the illustrated embodiment, the sheet 96 is unitary (formed as one piece) and bent at ninety-degree angles so that it resembles a square wave in side cross-section. Those of ordinary skill in the art will appreciate that in other embodiments the ribs 98 and the acoustic chambers 92 may be formed by multiple sheets secured to one another at their edges, rather than by a unitary bent sheet 96. Further, as used herein the term bent does not necessarily refer to the manner of forming the ribs 98 and the acoustic chambers 92. Rather, bent refers to the finished shape of the sheet material 96 that forms the ribs 98 and the acoustic chambers 92. Those of ordinary skill in the art will further appreciate that in alternative embodiments the unitary sheet 96 may be bent at angles other than ninety-degrees. Further, since cavities separate adjacent acoustic chambers, the resonators 82, 84 may include more than one unitary sheet 96.

With reference to FIGS. 7 and 8, in the first embodiment 82 intermediate perforated sheets 100 subdivide the acoustic chambers 92 into radially inboard subchambers 102 and radially outboard subchambers 104. In the embodiment 82 of FIG. 7 each acoustic chamber 92 includes a separate intermediate perforated sheet 100 attached at either end to the ribs 98. In the embodiment 84 of FIG. 8, by contrast, a unitary intermediate sheet 106 extends through each of the acoustic chambers 92, following the bent contours of the ribs 98. Portions 107 of the intermediate sheet 106 that extend fore to aft include perforations 109. As described above, the intermediate perforated sheets 100, 106 enhance the sound attenuation capacity of the resonator 82, 84.

As illustrated in FIGS. 7 and 8, in certain embodiments portions of the present acoustically treated exhaust centerbody are formed of relatively thin sheet material. Further, the perforated sheets may have any of a wide range of percentage perforation. The percentage perforation of a sheet is the ratio of the area of the perforations to the total surface area of perforated portion of the sheet. A non-perforated sheet would thus have a 0% perforation, while a 100% perforated sheet would be empty space.

FIG. 9 illustrates a schematic side cross-sectional view of another alternative embodiment of the resonator 108 of the present acoustically treated exhaust centerbody. The resonator 108 of FIG. 9 is similar to the resonators 82, 84 illustrated in FIGS. 7 and 8, and includes a perforated skin 110, an underlying unitary sheet 112 and an intermediate perforated sheet 114. In contrast to FIGS. 7 and 8, however, in the resonator 108 of FIG. 9 the unitary sheet 112 and the intermediate perforated sheet 114 are not bent at corners. Rather, they are bent at relatively small diameter arcs, so that each sheet 112, 114 resembles a sine wave in side cross-section.

FIGS. 10-13 illustrate another embodiment of the present acoustically treated exhaust centerbody 116. The exhaust centerbody 116 of FIGS. 10-13 is substantially similar to that shown in FIGS. 1-4, except that the resonator 44 includes only two cavities 50 that subdivide the acoustic chambers 118 into two circumferentially spaced groups 62, 64. The cavities 50 are diametrically opposed, such that the ribs 46 are shaped as half annuluses. Those of ordinary skill in the art will appreciate that in an embodiment including only two cavities 50 the cavities 50 need not necessarily be diametrically opposed. In such an embodiment the ribs would not be symmetric.

When deployed in a jet engine 24, as shown in FIG. 5, the present acoustically treated exhaust centerbody receives relatively hot exhaust gases and relatively cool vented air. The exhaust gases flow over the outer surface of the exhaust centerbody, while the vented air flows through the internal passageway of the exhaust centerbody. The difference in temperature between the internal passageway and the outer surface creates radially directed thermal gradients 119 (FIG. 1) in the exhaust centerbody. The thermal gradients 119 in turn may create thermal stresses in the exhaust centerbody.

The configuration of the resonator advantageously strengthens the ability of the acoustic treatment to withstand these thermal stresses. For example, the ribs 40 subdivide the acoustic chambers 42, acting as fore/aft walls 41 or corrugations that enable the resonator 30, 44, 80, 82, 84, 108 to expand and contract along the longitudinal axis 27 (FIG. 1). Similarly, the cavities provide circumferential (hoopwise) corrugations that enable the resonator to expand and contract circumferentially and radially (in the direction of the gradients 119 in FIG. 1). The entire resonator thus acts much like the pleats in an accordion.

Figure 16:
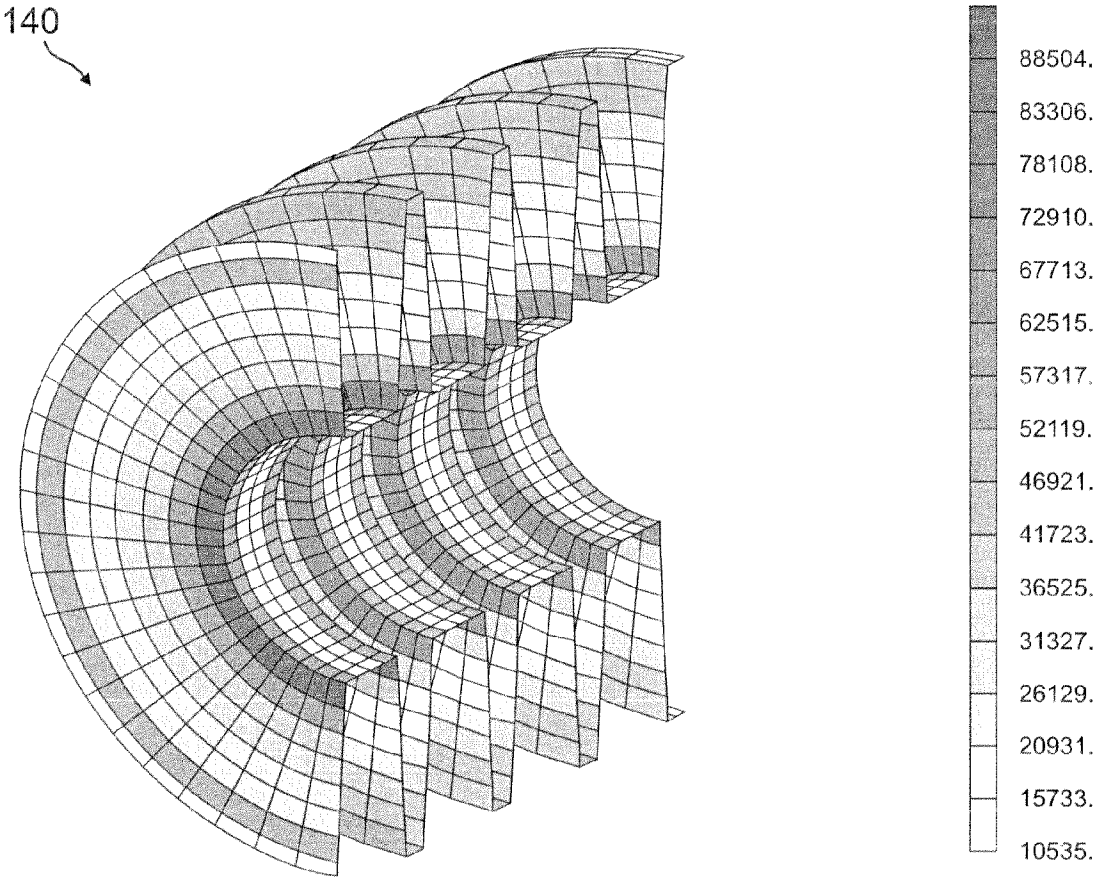
FIG. 16 is a front perspective stress diagram of a section of a resonator portion of an exhaust centerbody that does not include cavities separating adjacent acoustic chambers in the circumferential direction.
Figure 17:
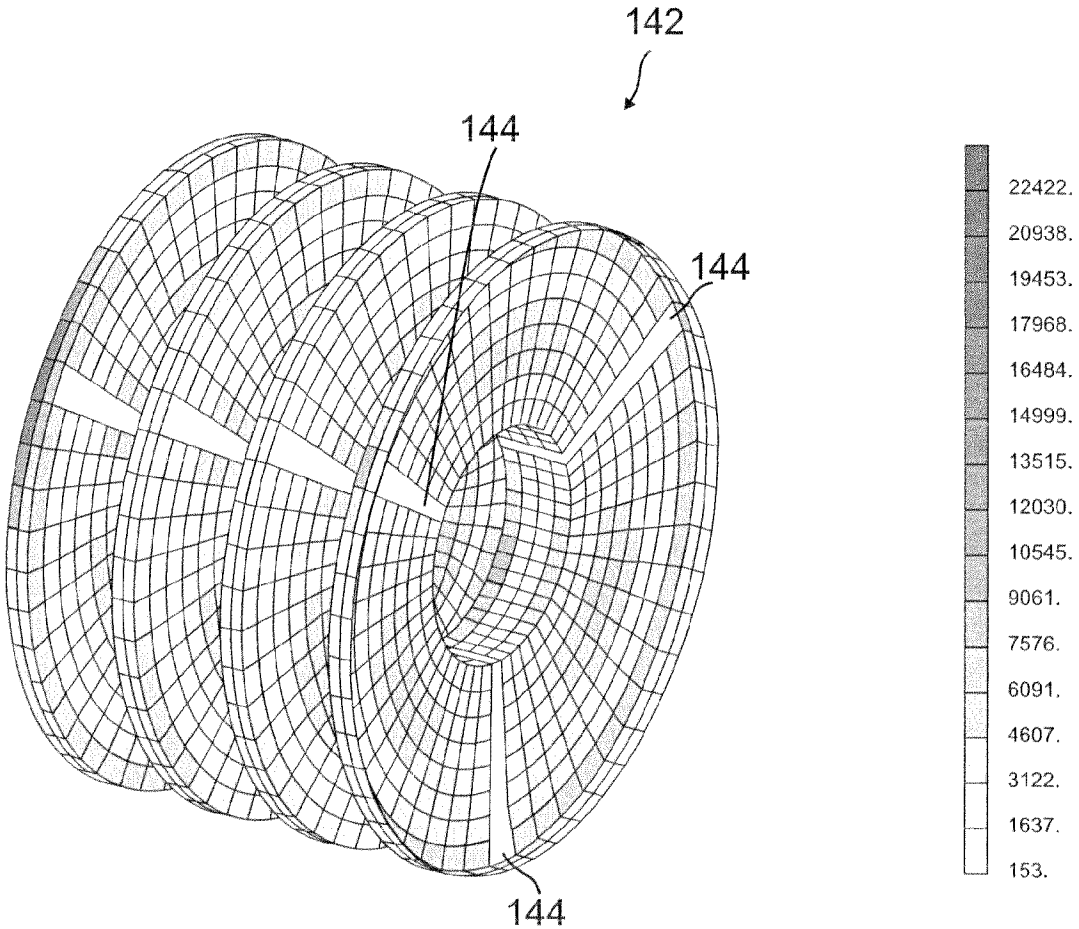
FIG. 17 is a front perspective stress diagram of a resonator portion of an exhaust centerbody that includes cavities separating adjacent acoustic chambers in the circumferential direction.

FIGS. 16 and 17 compare the stresses that develop in two resonator portions that are subjected to the same test conditions. The first resonator portion 140 does not include cavities separating adjacent acoustic chambers in the circumferential direction. The second resonator portion 142 includes three cavities 144. The scales to the right of the resonator portions 140, 142 indicate the stresses in the resonator portions 140, 142 in kilopounds per square inch (ksi). In the first resonator portion 140, the stresses range up to approximately 80,000 ksi, while in the second resonator portion 142 the stresses range up to only approximately 12,000 ksi. This dramatic difference in stresses results at least in part from the accordion effect created by the cavities 144.

Figure 14:
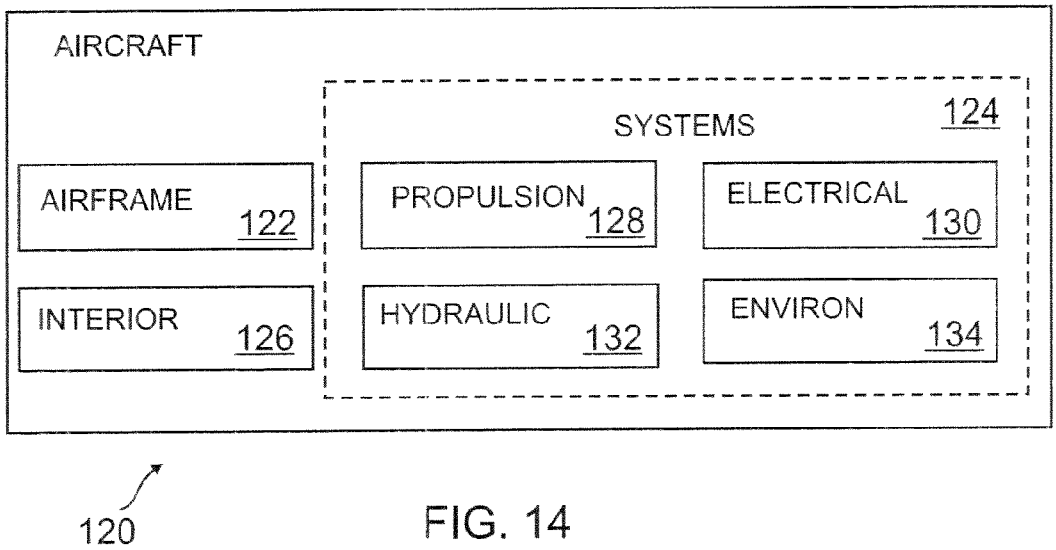
FIG. 14 is a block diagram of an aircraft.

Embodiments of the present disclosure may be described in the context of an aircraft 120 as shown in FIG. 14. The aircraft 120 may include an airframe 122 with a plurality of systems 124 and an interior 126. Examples of high-level systems 124 include one or more of a propulsion system 128, an electrical system 130, a hydraulic system 132, and an environmental system 134. The propulsion system 128 may include a jet engine, such as the engine 24 shown in FIG. 5. Any number of other systems may be included. Although an aerospace example is shown, the principles of the present disclosure may be applied to other industries, such as the automotive industry.

Figure 15:
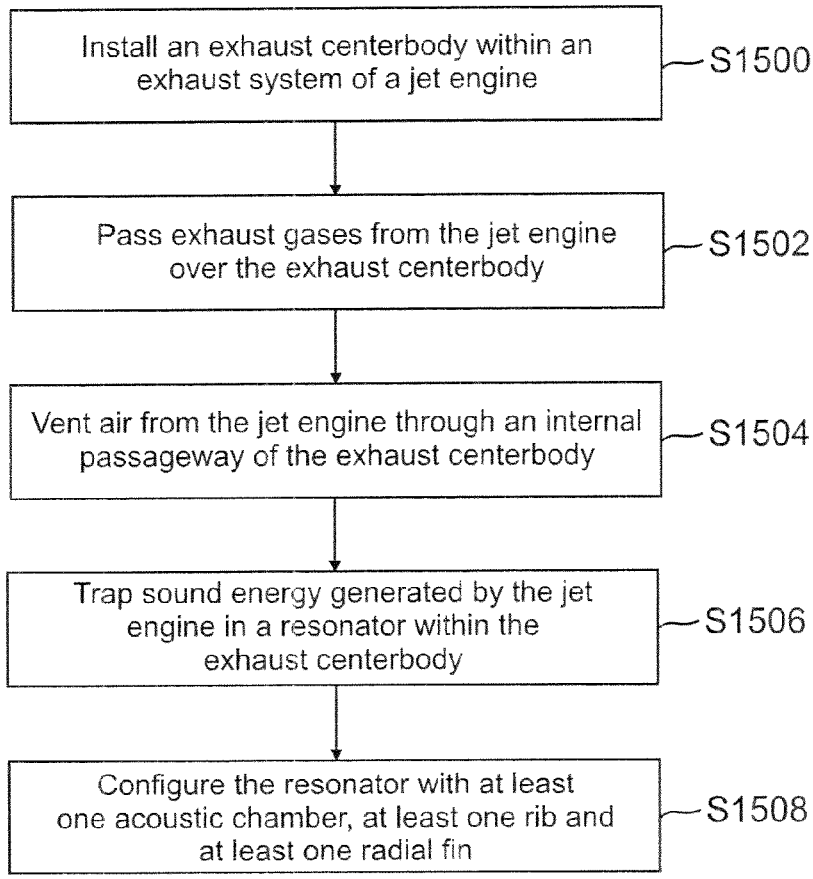
FIG. 15 is a flowchart illustrating one embodiment of the present methods for attenuating sound energy using an exhaust centerbody.

FIG. 15 illustrates the steps in one of the present methods of attenuating ambient noise generated by a jet engine. The method comprises installing an exhaust centerbody within an exhaust system of the jet engine, as shown at step S1500. The method further comprises passing exhaust gases from the jet engine over the exhaust centerbody, as shown at step S1502. The method further comprises venting air from the jet engine through an internal passageway of the exhaust centerbody, as shown at step S1504. The method further comprises trapping sound energy generated by the jet engine in a resonator within the exhaust centerbody, as shown at step S1506. The method further comprises configuring the resonator with at least one acoustic chamber, at least one rib and at least one radial fin, as shown at step S1508.

The above description presents the best mode contemplated for carrying out the present acoustically treated exhaust centerbody, and of the manner and process of making and using it, in such fall, clear, concise, and exact terms as to enable any person skilled in the art to which it pertains to make and use this exhaust centerbody. This exhaust centerbody is, however, susceptible to modifications and alternate constructions from that discussed above that are fully equivalent. Consequently, this exhaust centerbody is not limited to the particular embodiments disclosed. On the contrary, this exhaust centerbody covers all modifications and alternate constrictions coming within the spirit and scope of the exhaust centerbody as generally expressed by the following claims, which particularly point out and distinctly claim the subject matter of the exhaust centerbody.

What is claimed is:

1. An exhaust centerbody, comprising:

a body including a body fore portion and a body aft portion;

an internal passageway extending through the body in an axial direction;

a resonator in the body fore portion, the resonator including a plurality of acoustic chambers;

a plurality of ribs in the resonator with each rib extending along an interior circumference of the resonator, each rib forming a wall of one of the acoustic chambers with two walls between adjacent acoustic chambers;

a plurality of radial fins extending between adjacent ribs, the fins forming sidewalls of the acoustic chambers; and a skin overlying the acoustic chambers and forming an outer surface of the resonator.

2. The exhaust centerbody of claim 1, wherein the exhaust centerbody is configured to fit within an exhaust system of a jet engine such that exhaust gases from the jet engine travel over the exhaust centerbody.

3. The exhaust centerbody of claim 1, wherein each rib is shaped substantially as a section of an annulus.

4. The exhaust centerbody of claim 1, wherein the fins extend between adjacent ribs at edges thereof.

5. The exhaust centerbody of claim 1, wherein the skin includes perforations that facilitate the passage of sound energy through the skin so that the acoustic chambers trap the sound energy and attenuate the ambient noise generated by the jet engine.

6. The exhaust centerbody of claim 1, further comprising a plurality of cavities extending through the resonator in the axial direction, sidewalls of each cavity being defined by the radial fins such that the cavities separate adjacent acoustic chambers in the circumferential direction.

7. The exhaust centerbody of claim 6, wherein two opposed cavities are provided such that each rib is shaped substantially as a half annulus.

8. The exhaust centerbody of claim 6, wherein three cavities are provided.

9. The exhaust centerbody of claim 6, wherein the three cavities are evenly spaced in the circumferential direction such that each rib is shaped substantially as a third of an annulus.

10. The exhaust centerbody of claim 6, wherein each cavity extends from the internal passageway to the skin.

11. The exhaust centerbody of claim 1, wherein the aft portion tapers inward in a fore-to-aft direction.

12. The exhaust centerbody of claim 5, further comprising a perforated sheet extending through at least one of the acoustic chambers, the perforated sheet being located between the skin and the internal passageway and subdividing the at least one of the acoustic chambers into a radially inboard subchamber and a radially outboard subchamber.

13. A method of attenuating sound energy generated by a jet engine, the method comprising:

installing an exhaust centerbody within an exhaust system of the jet engine;

passing exhaust gases from the jet engine over the exhaust centerbody;

venting air from the jet engine through an internal passageway of the exhaust centerbody;

trapping the sound energy generated by the jet engine in a resonator within the exhaust centerbody;

configuring the resonator with at least one acoustic chamber, at least one rib and at least one radial fin;

configuring the resonator with a plurality of acoustic chambers; and configuring the resonator with a plurality of ribs with each rib extending along an interior circumference of the resonator, each rib forming a wall of one of the acoustic chambers with two walls between adjacent acoustic chambers.

14. The method of claim 13, further comprising configuring the resonator with a plurality of radial fins extending between adjacent ribs, the fins forming sidewalls of the acoustic chambers.

15. The method of claim 14, further comprising configuring the resonator with a perforated skin overlying the acoustic chambers and forming an outer surface of the resonator.

16. The method of claim 13, wherein each rib is shaped substantially as a section of an annulus.

17. The method of claim 14, wherein the fins extend between adjacent ribs at edges thereof.

18. The method of claim 14, wherein the resonator further comprises a plurality of cavities extending through the resonator in the axial direction, sidewalls of each cavity being defined by the radial fins such that the cavities separate adjacent acoustic chambers in the circumferential direction.

19. The method of claim 18, wherein two diametrically opposite cavities are provided such that each rib is shaped substantially as a half annulus.

20. The method of claim 18, wherein three cavities are provided.

21. The method of claim 20, wherein the three cavities are evenly spaced in the circumferential direction such that each rib is shaped substantially as a third of an annulus.

22. The method of claim 13, wherein at least one of the acoustic chambers further comprises a perforated sheet extending therethrough, the perforated sheet being located beneath the skin and subdividing the at least one of the acoustic chambers into a radially inboard subchamber and a radially outboard subchamber.

23. An exhaust centerbody configured to be disposed within an exhaust nozzle of a jet engine so that exhaust gases from the jet engine travel over an outside surface of the exhaust centerbody, while vented air from the jet engine travels through an internal passageway of the exhaust centerbody, the exhaust centerbody being further configured to attenuate sound energy generated by the jet engine, the exhaust centerbody comprising:

a body including a body fore portion and a body aft portion, with the internal passageway extending through the body in an axial direction and being configured to receive the vented air from the jet engine;

a resonator in the body fore portion, the resonator including a plurality of acoustic chambers configured to trap the sound energy;

a plurality of ribs in the resonator with each rib extending along an interior circumference of the resonator, each rib forming a wall of one of the acoustic chambers and being shaped substantially as a third of an annulus with two walls between adjacent acoustic chambers;

a plurality of radial fins extending between adjacent ribs, the fins forming sidewalls of the acoustic chambers;

three cavities extending in radial and axial directions through the resonator and subdividing the acoustic chambers into three circumferentially spaced groups, the radial fins defining sidewalls of the cavities; and a skin overlying the acoustic chambers and forming an outer surface of the resonator, the skin including perforations that enhance the ability of the acoustic chambers to trap the sound energy.

24. A method of attenuating sound energy generated by a jet engine using an exhaust centerbody disposed within an exhaust nozzle of the jet engine, the method comprising:

installing the exhaust centerbody within the exhaust nozzle of the jet engine;

passing exhaust gases from the jet engine over the exhaust centerbody;

passing vented air from the jet engine through an internal passageway of the exhaust centerbody; and trapping the sound energy generated by the jet engine in a resonator within the exhaust centerbody;

wherein the resonator includes a body including a body fore portion and a body aft portion, with the internal passageway extending through the body in an axial direction and being configured to receive the vented air from the jet engine;

a resonator in the body fore portion, the resonator including a plurality of acoustic chambers configured to trap the sound energy;

a plurality of ribs in the resonator with each rib extending along an interior circumference of the resonator, each rib forming a wall of one of the acoustic chambers and being shaped substantially as a third of an annulus with two walls between adjacent acoustic chambers;

a plurality of radial fins extending between adjacent ribs, the fins forming sidewalls of the acoustic chambers;

three cavities extending in radial and axial directions through the resonator and subdividing the acoustic chambers into three circumferentially spaced groups, the radial fins defining sidewalls of the cavities; and a skin overlying the acoustic chambers and forming an outer surface of the resonator, the skin including perforations that enhance the ability of the acoustic chambers to trap the sound energy.

* * * * *